US010210729B2

(12) United States Patent
Pulliam

(10) Patent No.: US 10,210,729 B2
(45) Date of Patent: Feb. 19, 2019

(54) SYSTEM, METHOD, AND APPARATUS FOR MONITORING AND ALERTING

(71) Applicant: Interact Solutions, LLC, Alpharetta, GA (US)

(72) Inventor: Haywood Pulliam, Suwanee, GA (US)

(73) Assignee: Interact Solutions, LLC, Alpharetta, GA (US)

( * ) Notice: Subject to any disclaimer, the term of this patent is extended or adjusted under 35 U.S.C. 154(b) by 267 days.

(21) Appl. No.: 15/140,861

(22) Filed: Apr. 28, 2016

(65) Prior Publication Data

US 2016/0321887 A1 Nov. 3, 2016

Related U.S. Application Data

(60) Provisional application No. 62/155,492, filed on May 1, 2015.

(51) Int. Cl.
*G08B 13/196* (2006.01)
*G08B 25/08* (2006.01)

(52) U.S. Cl.
CPC ... *G08B 13/1966* (2013.01); *G08B 13/19665* (2013.01); *G08B 13/19689* (2013.01); *G08B 25/08* (2013.01)

(58) Field of Classification Search
CPC ..... G08B 13/1966; G08B 13/19665; G08B 13/19689; G08B 25/08
See application file for complete search history.

(56) References Cited

U.S. PATENT DOCUMENTS 5,714,932 A * 2/1998 Castellon ..... G08B 21/0227 340/539.11
5,745,034 A * 4/1998 Andersen ..... A61B 5/0002 340/573.1
5,977,913 A * 11/1999 Christ ..... G01C 21/206 340/524
6,975,220 B1 * 12/2005 Foodman ..... G06F 17/3089 340/531
7,015,817 B2 * 3/2006 Copley ..... G08B 21/0283 340/539.13
8,116,724 B2 * 2/2012 Peabody ..... G08B 25/016 455/404.2
8,659,414 B1 * 2/2014 Schuk ..... G08B 21/0202 307/10.1
9,642,529 B1 * 5/2017 Siddiqui ..... A61B 5/0008
2005/0058026 A1 * 3/2005 Hocherman ..... G04G 13/026 368/73
2008/0156406 A1 * 7/2008 Breed ..... B60C 23/041 152/415
2012/0271646 A1 * 10/2012 Feldman ..... G08B 21/04 705/2

(Continued)

*Primary Examiner* — Nhon T Diep
(74) *Attorney, Agent, or Firm* — Larson & Larson, P.A.; Frank Liebenow; Justin P. Miller

(57) ABSTRACT

An alert system includes a computer system and several transmitting devices wirelessly connected to the computer system such that operation of a switch on any one of the transmitting devices transmits a signal to the computer system. There is at least one video camera coupled to the computer system. Software running on the computer system initiates capture of video from at least one of the video cameras responsive to detecting receipt of the signal from the any one of the transmitting devices.

16 Claims, 12 Drawing Sheets

(56) References Cited

U.S. PATENT DOCUMENTS

| | | | | |
|---|---|---|---|---|
| 2013/0331058 | A1* | 12/2013 | Harvey | H04W 4/90<br>455/404.2 |
| 2014/0368643 | A1* | 12/2014 | Siegel | G08B 13/19695<br>348/143 |
| 2015/0204109 | A1* | 7/2015 | Ergenbright | G05B 13/00<br>340/541 |
| 2016/0063851 | A1* | 3/2016 | Vaidyanathan | H04W 4/22<br>340/539.13 |
| 2017/0257967 | A1* | 9/2017 | Obrist | H05K 7/1424 |

* cited by examiner

SYSTEM, METHOD, AND APPARATUS FOR MONITORING AND ALERTING

CROSS-REFERENCE TO RELATED APPLICATION

This application claims the benefit of U.S. provisional application No. 62/155,492 filed on May 1, 2015, the disclosure of which is incorporated by reference.

FIELD

This invention relates to the field of monitoring and alerting; and more particularly to a system for initiating alerts from a classroom.

BACKGROUND

Teaching personnel (professors, teachers, aides, administrators, etc.) have a difficult task of eliminating distraction and maintaining student safety. With a litigious society, it is very difficult for teaching personnel to maintain the line between discipline and excessive force, badgering, belittling, bullying, etc. Parents are often unaware of their child's behavior and are usually in disbelief that their child is capable of whatever has happened in the classroom, often leading to escalation of the incident to the school administration, police, and court system when, many time, their child has done something that likely warranted the reaction of the teaching personnel.

To further make the situation worse, recently there have been several incidents in which students or outsiders have entered a school with the intent of harming students and/or teaching personnel. There have been countless reports of incidents where students were harmed, guns or knives were found in the possession of students, unauthorized people have entered school, etc. There are several notorious incidences in recent years where lives were lost, a loss that may be preventable given proper screening and alerting.

Further, when a teaching personnel member addresses an individual for a matter of any severity, there is often little evidence regarding how that member dealt with the matter. Did the member properly address the situation or was the member abusive; did the member use excessive force; did the member harm the offender, etc.? Often, after the incident, memories of the individuals involved and witnessing the event fade of are influenced by outsiders, for example, by peer pressure. It is quite possible that some teaching personnel receive unwarranted discipline, firing, criminal charges, civil suits, etc., for something that is blown out of proportion. Likewise, even in absence of such extremes, there are little or no mechanisms to provided positive and/or negative feedback to teaching personnel.

In some teaching environments, constant video surveillance of the teaching sessions is not permitted due to union contracts and other legal issues and/or fears. Yet, there are times the teaching staff want to record specific lessons or other segments of a teaching experience.

What is needed is a system that will provide teaching personnel initiated alerting and recording.

SUMMARY

In one embodiment, an alert system is disclosed including a computer system and several transmitting devices wirelessly connected to the computer system such that operation of a switch on any one of the transmitting devices transmits a signal to the computer system. There is at least one video camera coupled to the computer system. Software running on the computer system initiates capture of video from at least one of the video cameras responsive to detecting receipt of the signal from any one of the transmitting devices.

In another embodiment, an alert system is disclosed including a computer system and a plurality of wireless transceivers that are interfaced to the computer system. Each of the wireless transceivers located associated with a location of a facility. There is a plurality of transmitting devices wirelessly connected to the computer system such that operation of a momentary-contact switch on any one of the transmitting devices transmits a wireless signal. There is at least one video camera operatively coupled to the computer system. Software running on the computer system monitors the plurality of wireless transceivers, waiting for reception and detection of the wireless signal from any of the wireless transceivers. The software initiates capture of video from at least one of the at least one video camera responsive to the software detecting receipt of the signal from one of the transmitting devices by one of the wireless transceivers.

In another embodiment, an alert system is disclosed, including a computer system that has a wireless receiver and a transmitting device that has a momentary-contact switch for controlling when the transmitting device emits a wireless signal. There is at least one video camera operatively coupled to the computer system. Software running on the computer system initiates capture of video from at least one of the at least one video camera responsive to the software detecting receipt of the wireless signal from the transmitting device.

In another embodiment, a method of alerting is disclosed including transmitting a wireless signal by activating a momentary-contact switch of a transmitting device for a period of time. Upon receiving and detecting the wireless signal, initiating capture of video from at least one video camera associated with a location of the transmitting device. If the period of time (e.g., the length of the wireless signal) is greater than a predetermined threshold, signaling an alarm.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
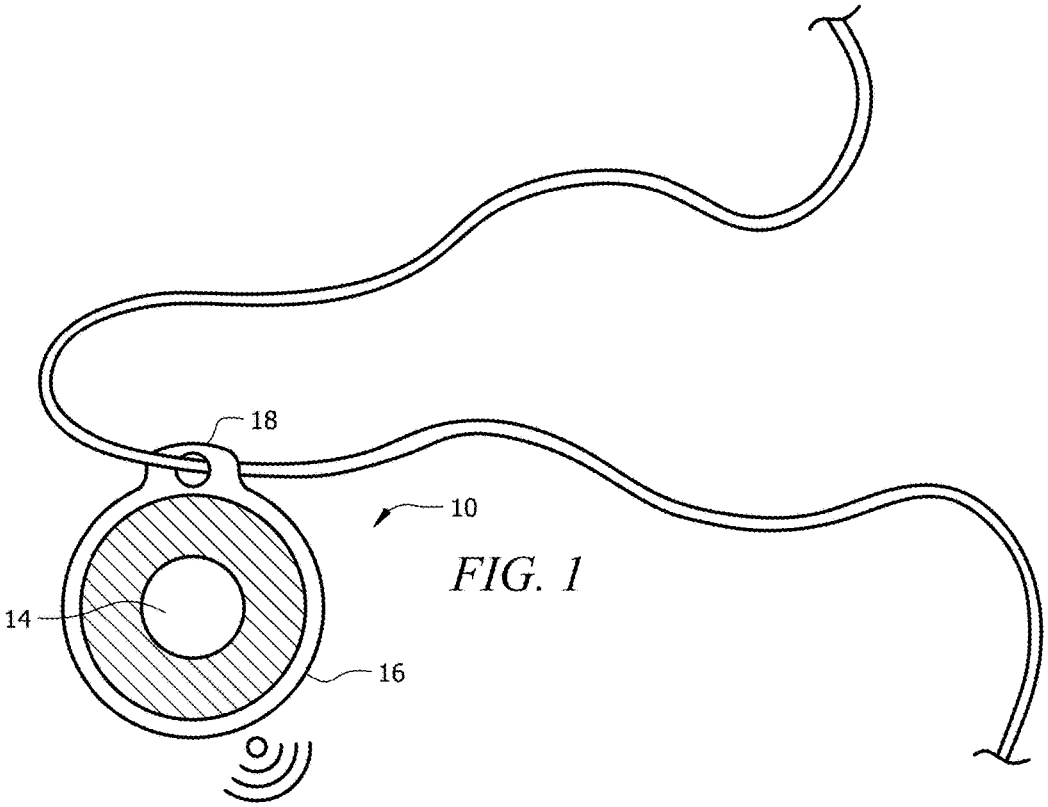
FIG. 1 illustrates a schematic view of a transmitting device.

Reference will now be made in detail to the presently preferred embodiments of the invention, examples of which are illustrated in the accompanying drawings. Throughout the following detailed description, the same reference numerals refer to the same elements in all figures.

In general, the alert system provides for a set of body-wearable or body-carryable devices 10 (see FIGS. 1-3) that are capable of transmitting a wireless signal to initiate an alert. The alert informing administrative staff and/or law enforcement that the incident is occurring and initiating recording and retention of records related to the incident. With a single transmitting device 10 per teaching personnel member, the teaching personnel members are provided with a security system to initiate alerts at multiple levels. For example, if a student is not behaving, a low-level alert is initiated by pressing a button 14 (see FIGS. 1-3) on the transmitting device 10. If something more sever happens such as a student is found to have a weapon (e.g., a gun, a knife, and mace), the button 14 is held for a number of seconds (e.g., three seconds) and a major-alert is initiated. In some scenarios, the major alert automatically initiates certain activities such as notifying authorities, locking down, signaling an audible/visible alarm, etc. Notification is made by any of various mechanisms, depending upon alert severity. For example, a message on an administrator's display, an email to an administrator, a text message (e.g., Short Message Service—SMS) to an administrator, a transaction with a law enforcement server, auto dialing an emergency number and playing recorded voice instructions or converting voice instructions to speech using text-to-speech, etc.

Having such capabilities also provides a feature for the teaching personnel to initiate recording of, for example, a lesson for later review and/or presentation to a student that was not able to attend the class. In such, to initiate recording of a session, the teaching personnel initiates recording through pressing of the button 14 for a short interval, then after completion of the lesson, presses the button 14 again, for a short interval. The lesson is then compressed and stored for use by the teaching personnel and others.

Figure 2:
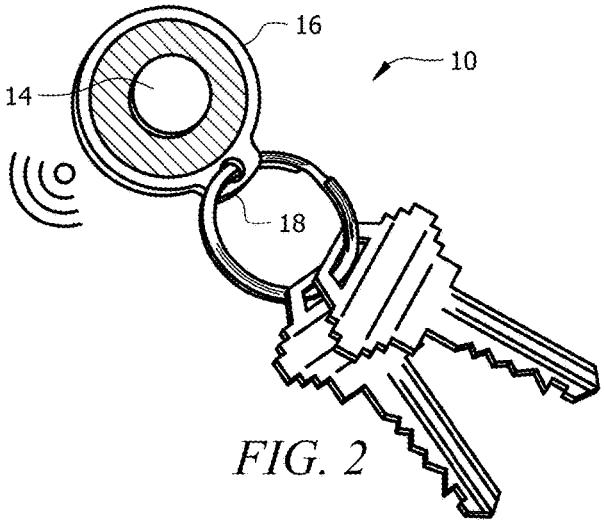
FIG. 2 illustrates a second plan view of the transmitting device.
Figure 3:
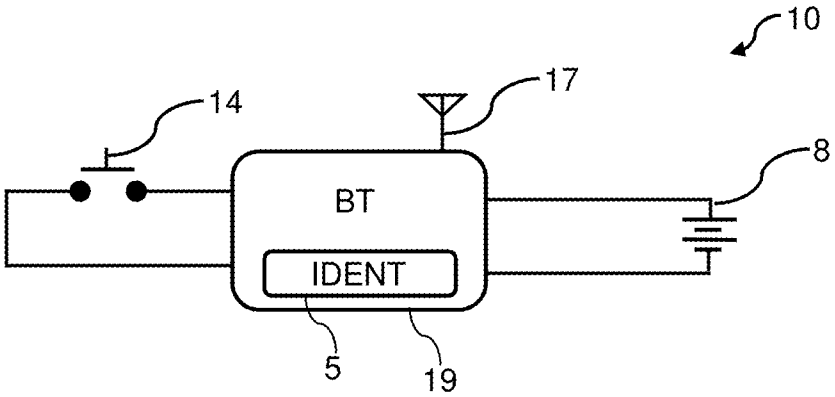
FIG. 3 illustrates a schematic view of the transmitting device.
Figure 4:
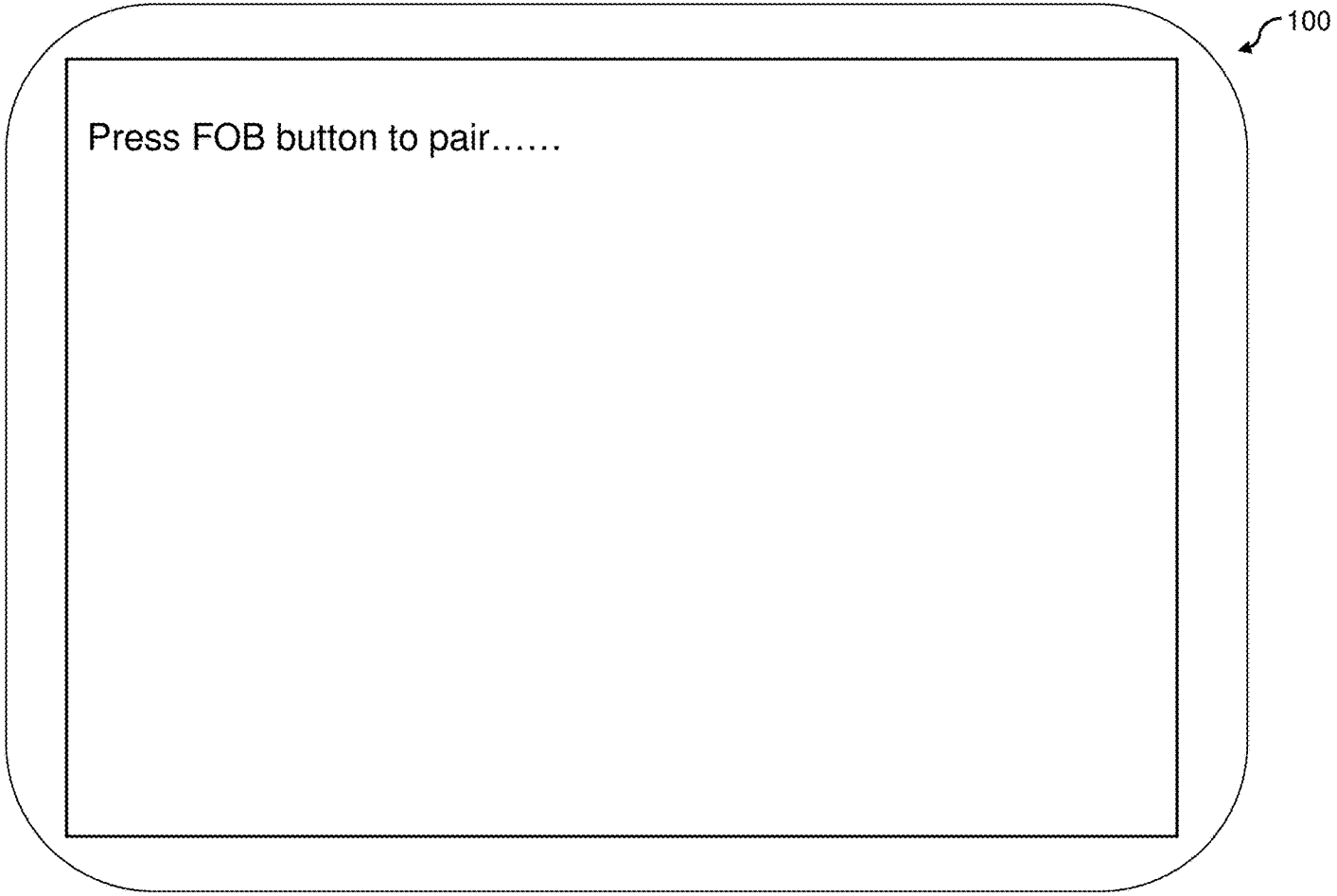
FIG. 4 illustrates a first user interface of the alert system.

Referring to FIGS. 1-3, one such transmitting device 10 is shown. The transmitting device 10 is a transmitting device 10 that is worn or carried by teaching personnel such as worn as a wrist device (e.g. bracelet or watch), a neck device (e.g., necklace as shown in FIG. 1), a pin (e.g., a brooch), carried in a pocket, clipped to a belt, shirt, pocket, etc. In the example shown in FIGS. 1-3, a small transmitting device 10 includes an enclosure 14, a switch actuator button 14 and an interface hole 18 for wearing as, for example, a necklace (as shown in FIG. 1) or on a key ring (as shown in FIG. 2), etc. In this exemplary transmitting device 10, the transmitting device 10 includes a switch/button 14 connected to a transmitter (e.g., Bluetooth transmitter 19 that has an antenna 17). In some such devices 10, the antenna 17 is a PCB antenna 17, though in other embodiments, other transmitters 19 are anticipated, transmitting wirelessly using any form of the radio frequency spectrum, light, sound, etc. It is also anticipated that the transmitting device 10 includes a battery 8 or other power source.

In some embodiments, the transmitting device(s) 10 have identifiers 5 (e.g., serial numbers) that uniquely identify each transmitting device 10, so that, when the switch 14 is activated, the identifier 5 is transmitted (encoded within the emitted wireless signal) so that, when received by the computer 60 (see FIG. 10), the computer 60 is able to determine which transmitting device 10 emitted the wireless signal. Having the identifier 5, the computer system 60 is able to correlate the wireless signal with a user (e.g., a teacher, professor, etc.) though not necessarily knowing that that user pressed the switch 14. In some embodiments, other security checking is performed to assure that the user is who activated the switch, such as using a biological sample (finger print, retinal scan, DNA sample, etc.), using a pin (requires a small keyboard), using a voice password, etc.

Although an interface hole 18 is optionally provided for wearing the transmitting device 10, it is fully anticipated that the transmitting device 10 be carried in a pocket, worn as a pin or cufflink, etc., hopefully carried/worn in a place that will not cause inadvertent activation.

Referring to FIGS. 4-9, user interfaces of the alert system are shown. Note that the user interfaces 100/110/120/130/140/150 are exemplary user interfaces and there is no limitation to any particular user interface sequence, user interface format, user interface paradigm, etc.

Figure 5:
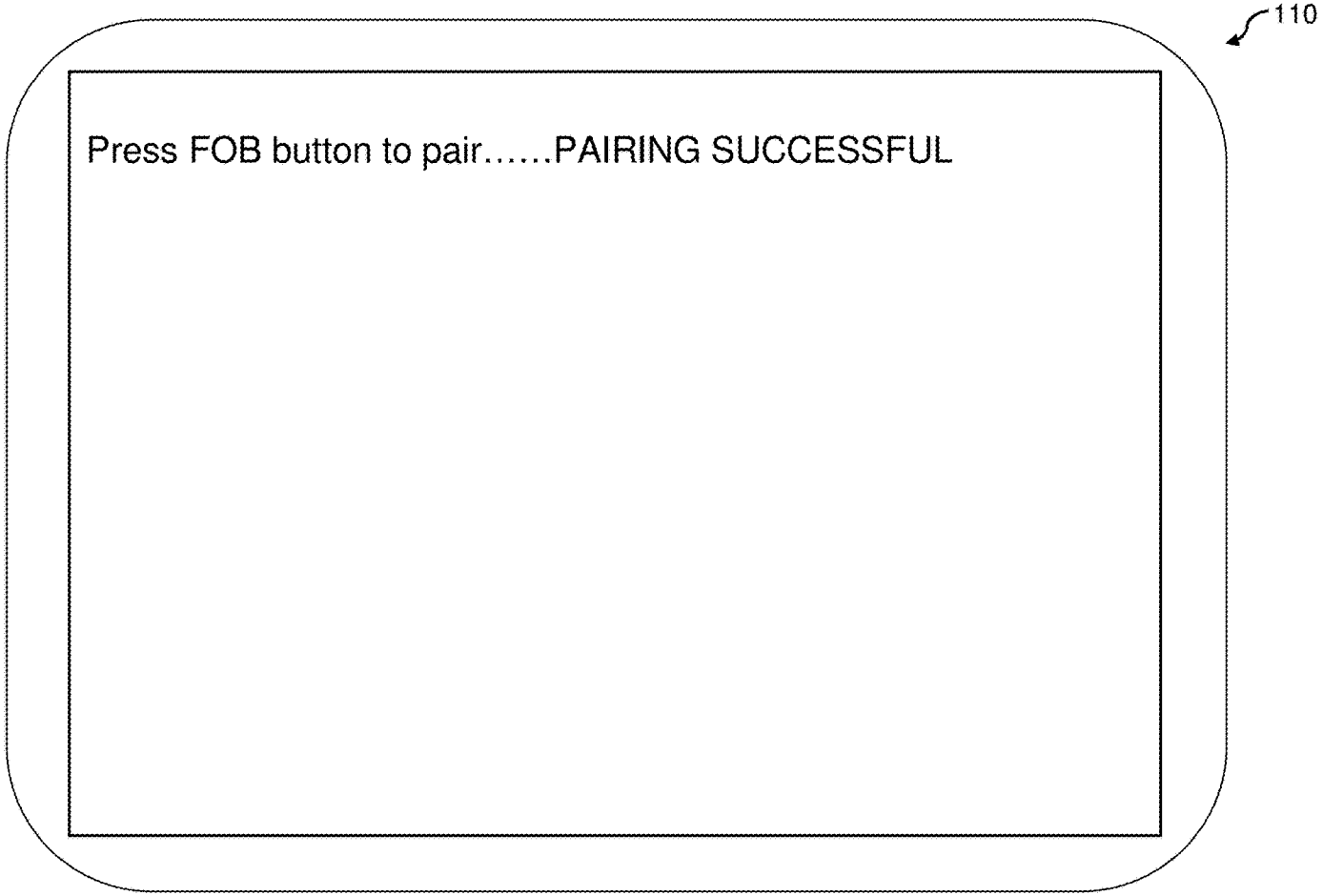
FIG. 5 illustrates a second user interface of the alert system.

When a new transmitting device 10 is introduced into the alarm system, the new transmitting device 10 must be activated, preferably by administrative personnel. This protects the alert system from mischievous or illegal tampering and possible false alarms from a transmitting device 10 that is not registered, at least to the security level of the particular transmitting device 10 and transmission protocol (e.g., Bluetooth). This is similar to the activation of a new garage door remote, as one does not want anybody with a garage door remote control to be able to open their garage door. Therefore, when a new transmitting device 10 is introduced, it is "paired" with the alert system by a program that presents a user interface 100 as in FIG. 4, requesting that the button 14 of the transmitting device 10 be pressed. After the button 14 of the transmitting device 10 is pressed, the user interface 110 as in FIG. 5 is displayed showing that the pairing is a success and the transmitting device 10 is now linked to the alert system. These steps are repeated for each transmitting device 10, as needed.

Figure 6:
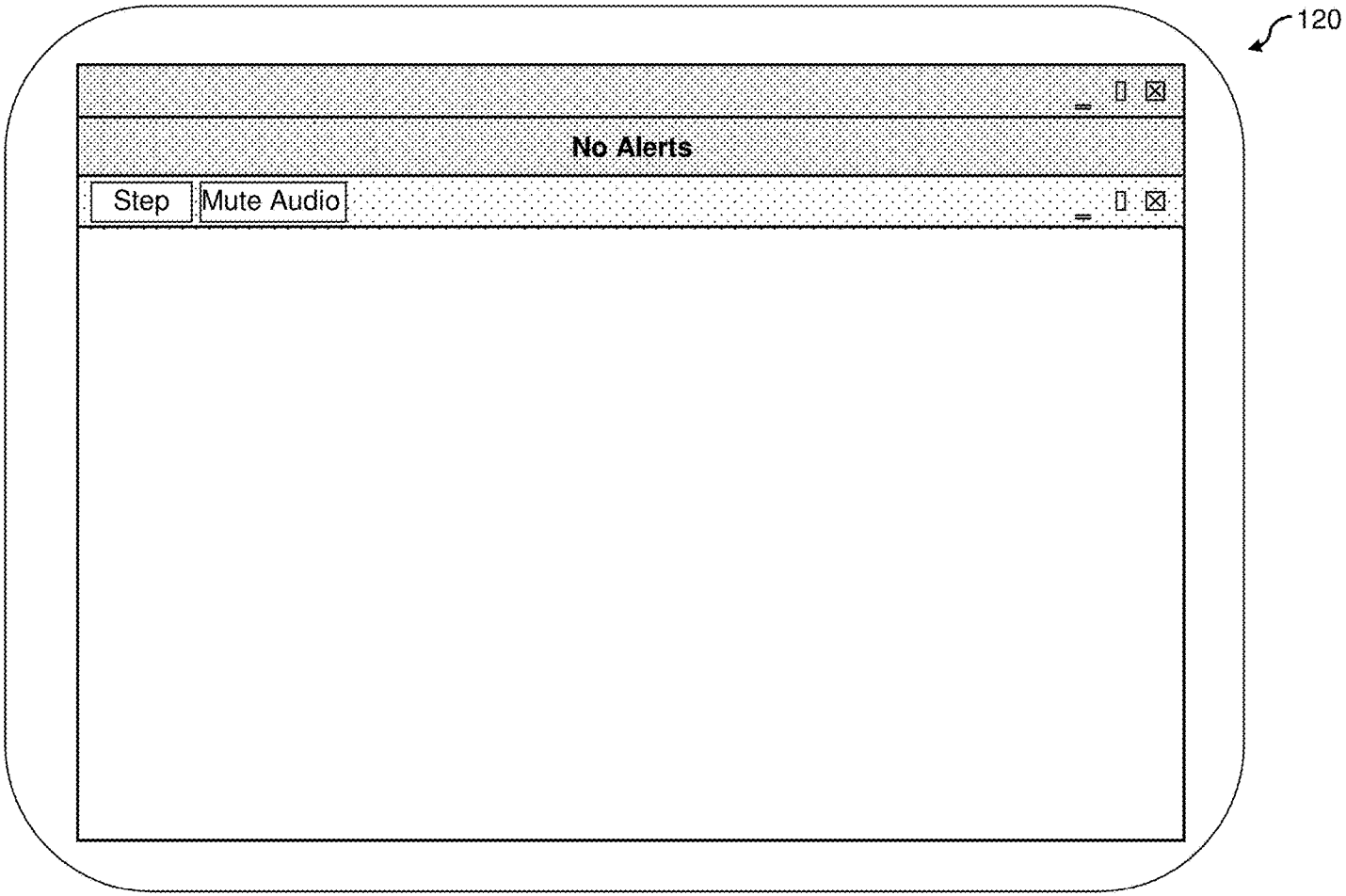
FIG. 6 illustrates a third user interface of the alert system.
Figure 7:
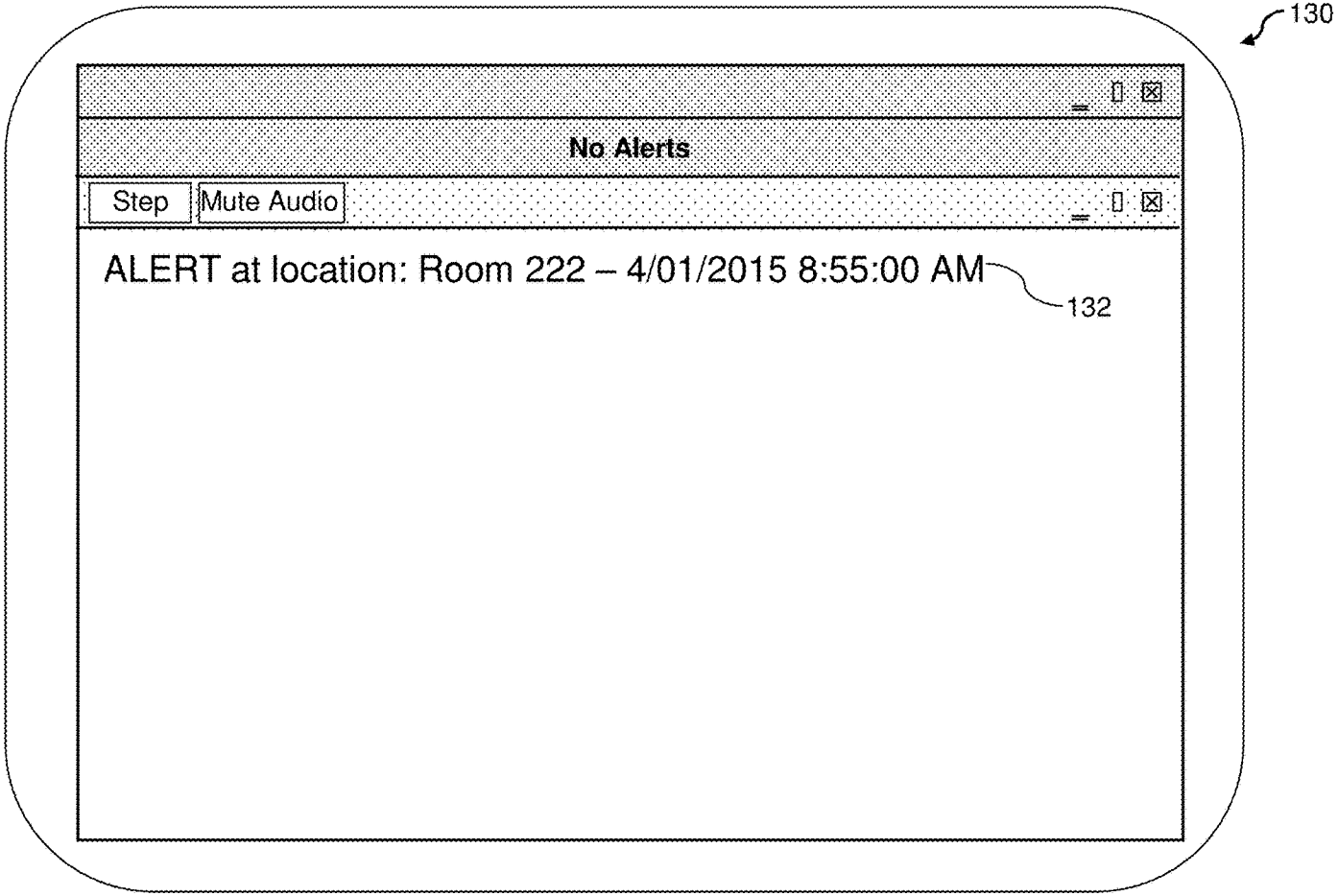
FIG. 7 illustrates a fourth user interface of the alert system.
Figure 8:
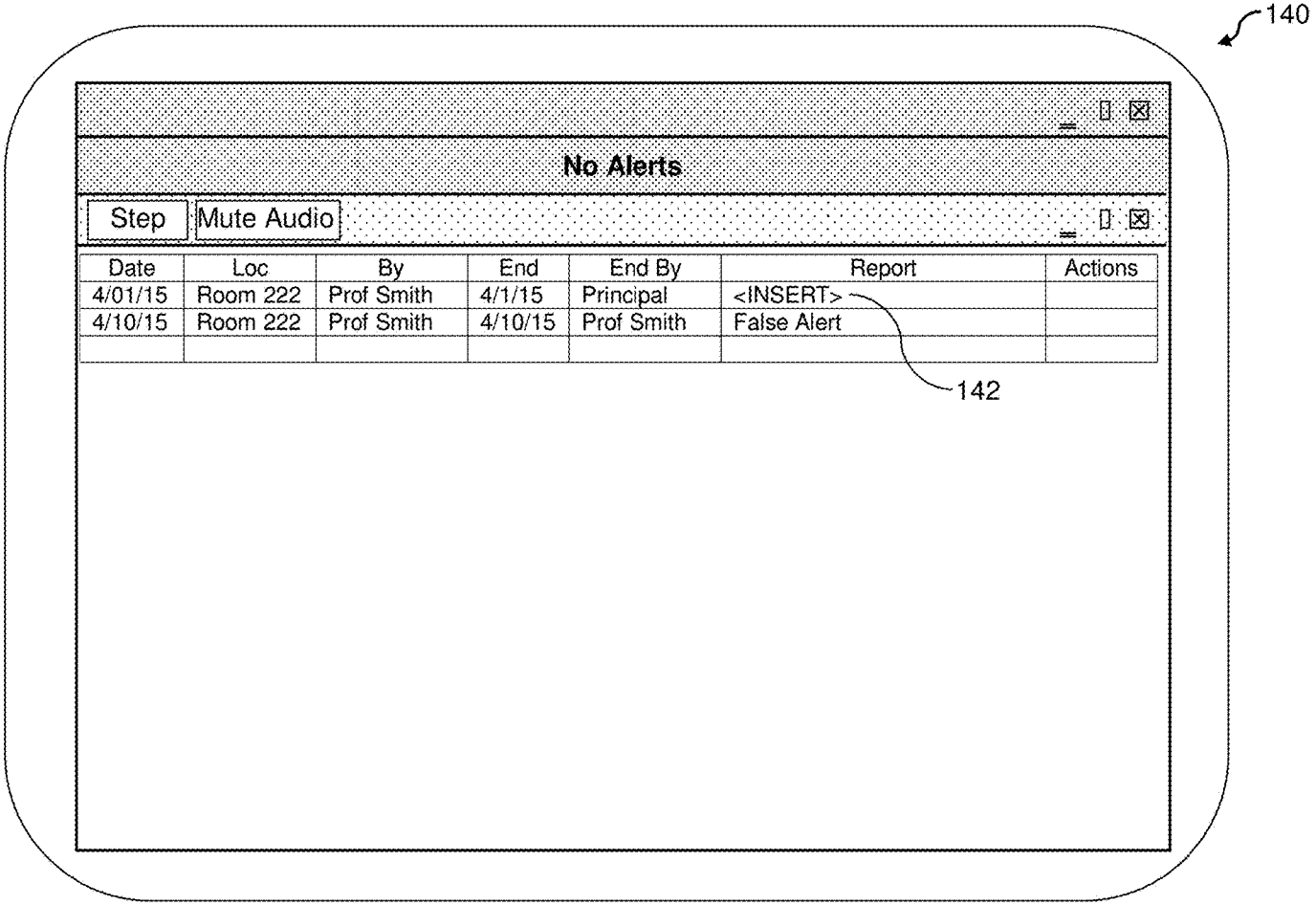
FIG. 8 illustrates a fifth user interface of the alert system.
Figure 9:
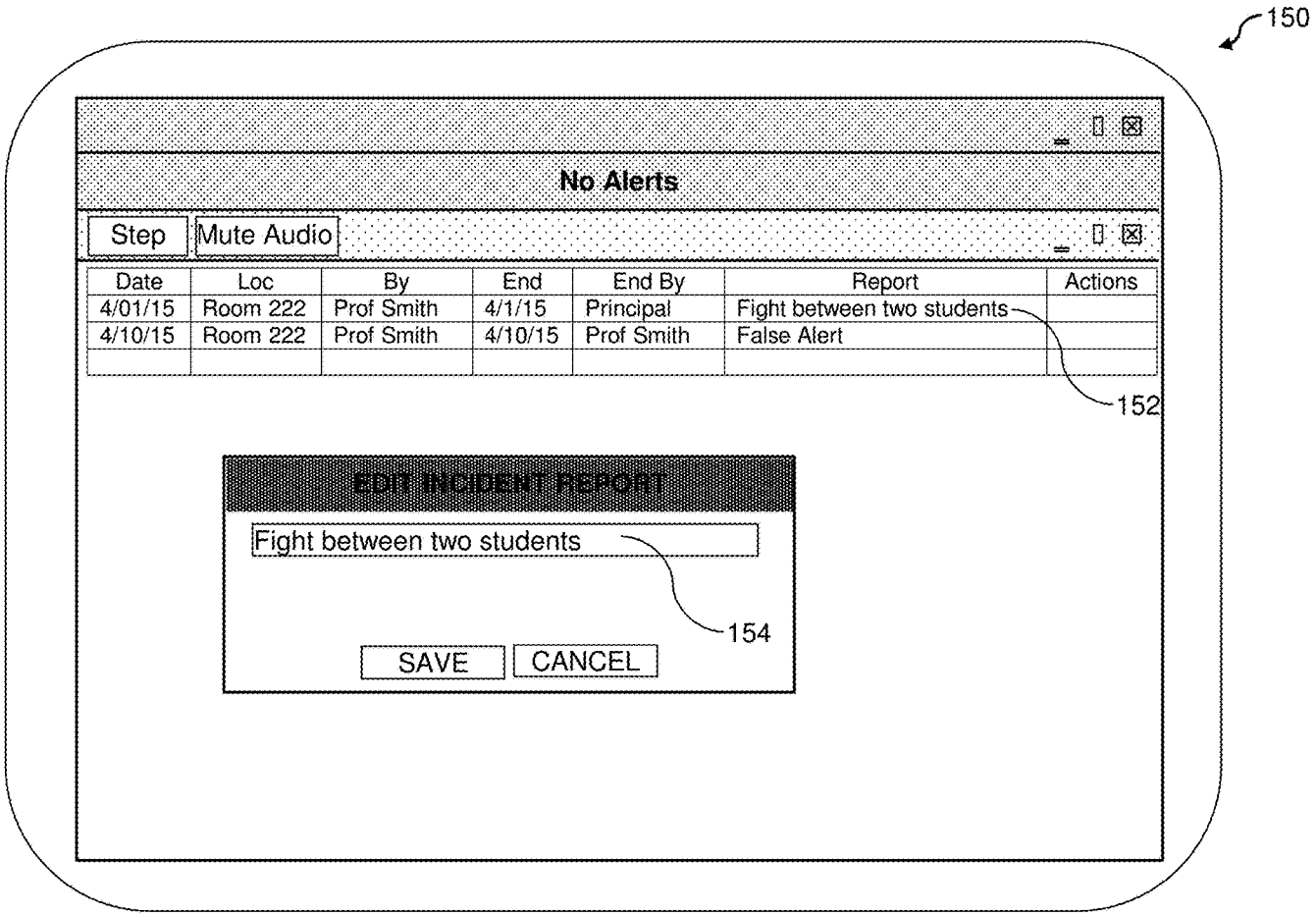
FIG. 9 illustrates a sixth user interface of the alert system.

During normal operation of the alert system, no alerts are active and a user interface 120 as shown in FIG. 6 is typically displayed. Now, if an incident occurs (e.g., a fight in the cafeteria), a teaching personnel signals the incident by pressing the button 14 on the transmitting device 10 that, preferably, the personnel carries or wears. Responsive to the signal, an alert 132 is displayed on a user interface 130 as shown in FIG. 7. Although various information is anticipated, in this example, the room number, date, and time are displayed on the alert 132, though in other embodiments, more or less information is displayed (e.g., the name of the teaching personnel who triggered the alarm, whether video is available, etc.).

If the incident is non-critical, then a later activation of the same transmitting device 10 will close the alert, keeping records 142 of the alert, along with any other data captured regarding the alert such as video from the room of the alert, etc. In some embodiments, administration has a user interface 140 as in FIG. 8 to show a history of alerts, with ability to annotate the alert as with user interface 150 in FIG. 9, in which administrative personnel add descriptions 152 of what happened ("fight between two students") to the record 142.

If the incident is critical (e.g., a student has a weapon), the teaching personnel holds the button 14 of the transmitting device 10 for a period of time (e.g., three seconds), initiating a critical alarm. In response to the critical alarm, based upon administrative settings, any or all of several actions take place such as notifying law enforcement through any form of messaging (e.g., text message, email, voice phone call), sounding of an audible alarm, initiating a visual alarm (e.g., flashing lights), automatic locking of certain doors, notification of key administrative personnel (e.g., by text messaging, email, etc.), etc. In some embodiments, if a voice phone call is made (e.g., to E911), a pre-recorded emergency messages is played after the emergency management personnel respond. In some embodiments, if a voice phone call is made (e.g., to E911), an emergency messages is converted from text to speech and played after the emergency management personnel respond.

Once a critical alarm is initiated, there is no mechanism using the transmitting device 10 for the teaching personnel that initiated the critical alarm to extinguish the alarm. The only way to extinguish the alarm is for an administrator or law enforcement person to access the administrative tools of the alert system and manually extinguish the alarm. In some embodiments, authentication (e.g., physical key, password, electronic fob) is required to extinguish the alarm.

Figure 10:
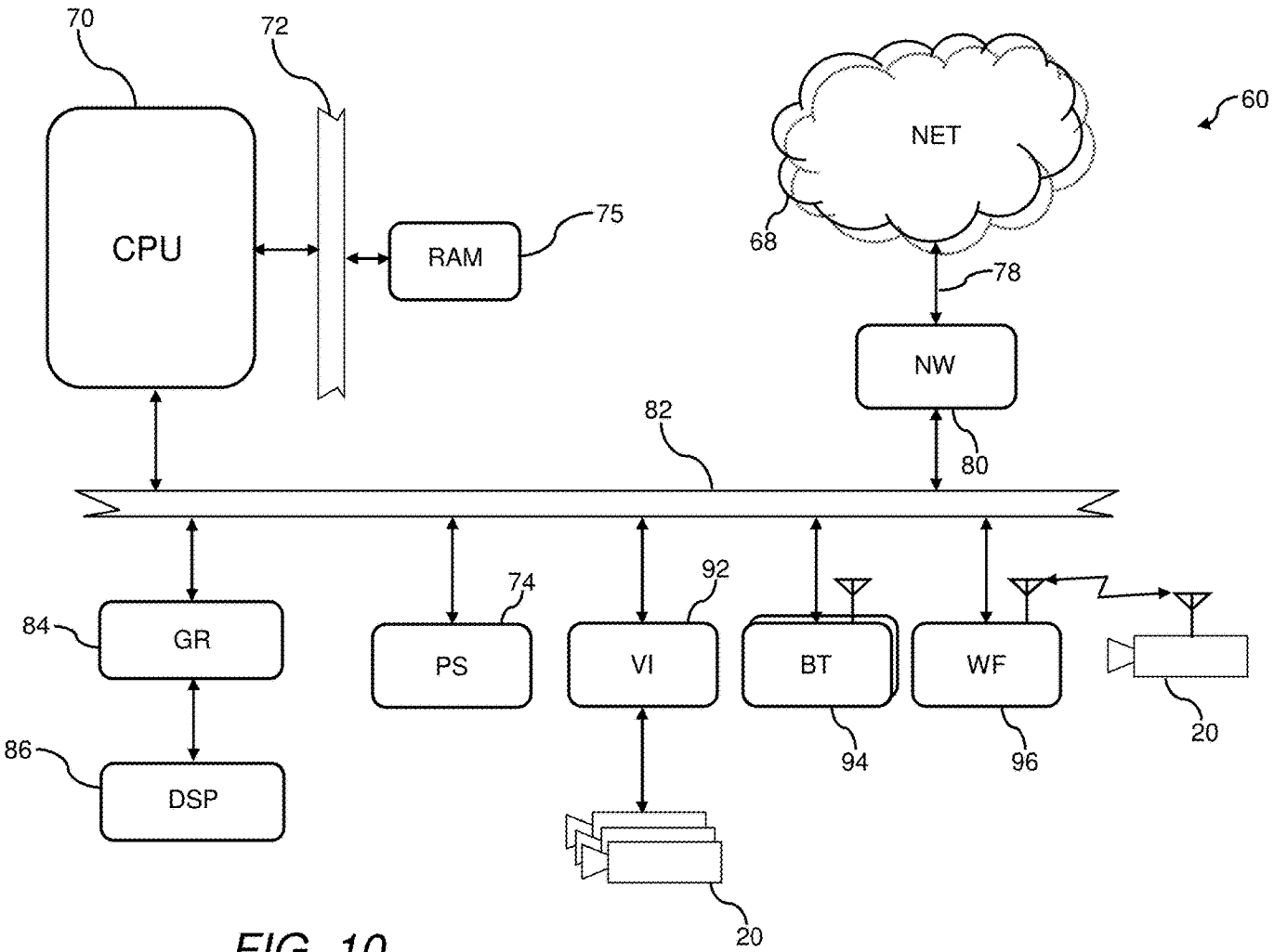
FIG. 10 illustrates a typical computer system of the alert system.

It is anticipated that some or all rooms, corridors, bathrooms, cafeterias, common areas, outside areas, etc., are equipped with one or more video cameras 20 (see FIG. 10). During an alarm, video is captured and stored (e.g. in storage 74—see FIG. 10) from each camera 20 to document exactly what happened, who was involved, how teaching personnel handled the incident, etc. The video is retained and associated with the alert 142 for review and documentation. The video is also available to the administration to review performance of teaching personnel and provide feedback and training when needed.

Referring to FIG. 10, a typical computer system 60 of the alert system is shown. The example computer system 60 represents a typical computer system used with the alert system for detecting alarms, recording alarms, recording data and video, notifying parties of the alarms, etc. This exemplary computer system 60 is shown in one form, but different architectures are known that accomplish similar results in a similar fashion and the present invention is not limited in any way to any particular computer system 60 architecture or implementation. In this exemplary computer system 60, a processor 70 executes or runs programs in a random access memory 75. The programs are generally stored within a persistent storage 74 and loaded into the random access memory 75 when needed. The processor 70 is any processor, typically a processor designed for general purpose computing. The random access memory 75 (e.g., flash memory, hard drive, etc.), is connected to the processor by, for example, a memory bus 72. The random access memory 75 is any memory 75 suitable for connection and operation with the selected processor 70, such as SRAM, DRAM, SDRAM, RDRAM, DDR, DDR-2, etc. The persistent memory 74 is any type, configuration, capacity of memory 74 suitable for persistently storing data and program instructions, for example, flash memory, read only memory, battery-backed memory, magnetic memory, magnetic disk, etc. The persistent memory 74 (e.g., flash memory, hard drive, etc.) is connected to the processor by, for example, a data bus 82 (e.g., PCI bus).

In some computer systems 60, some or all of the persistent memory 74 is removable, in the form of a memory card of appropriate format such as SD (secure digital) cards, micro SD cards, compact flash, etc.

A peripheral bus 82 (e.g., PCI bus) connects to the persistent memory 74 and other peripheral subsystems such as a graphics adapter 84 and a video interface 92. The graphics adapter 84 receives commands from the processor 70 and controls what is depicted on a display image on the display 86. Additionally, in most embodiments, wireless transceivers 94 (e.g., Bluetooth transceivers) and Wi-Fi transceivers 96 are connected to the processor 70 through the system bus 82. It is anticipated that the wireless transceivers 94 are distributed throughout a facility having one or more wireless transceivers 94 in each room of the facility. Through this set of wireless transceivers 94, software running on the computer system 60 is able to determine an approximate location of any wireless transmission (e.g., approximately in which room of the facility is there a disturbance), and using the identification 5, the computer system 60 is able to determine the person to which the wireless device 10 is assigned to report the likely person that has signaled the alarm.

The video interface 92 is connected to one or more video cameras 20, by any way known including wired and wireless connections. In some embodiments, one or more of the video cameras are connected through a wireless network, for example through the Wi-Fi transceiver 96.

The network interface 80 connects the computer system 60 to a network 68 through any cellular connection arrangement, including, but not limited to, a wired network such as Ethernet or a wireless network such as Wi-Fi (802.11). There is no limitation on the type of networking used. The network interface 80 provides data, and messaging services to the computer system 60 for communicating with other computer systems 60 within the alert system and/or communicating with external systems such as alarm systems, police departments, etc. In some embodiments, the network interface 80 includes interfaces to the phone system for initiating calls to E911, etc.

For local communications to one or more transmitting devices 10, one or more computer systems 60 include a wireless receiver that is paired with one or more transmitting devices. Any know wireless transmission system is anticipated, including radio-wave transmission systems such as Bluetooth, ultrasonic sound transmission systems, visible or invisible light transmission systems, etc. In examples shown, a Bluetooth radio transceiver 94 is used as an example of one transmission system, although a Wi-Fi radio transceiver 96, or both, is equally anticipated.

Figure 11:
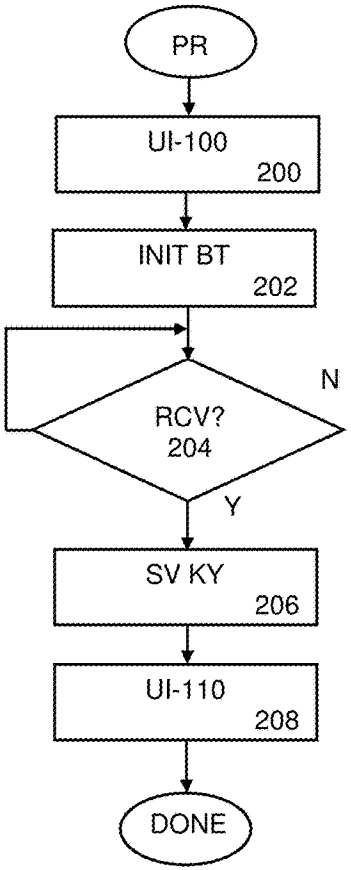
FIG. 11 illustrates a first software flow of the alert system.

Referring to FIG. 11, a first software flow of the alert system is shown. Each time the switch button 14 on a transmitting device 10 is pressed, the transmitting device 10 emits a signal packet requesting bonding to the computer system 60. A shared, secret key is included in the signal packet.

The flow of FIG. 11 is, for example, to register or "pair" one of the transmitting devices 10. In some protocols such as Bluetooth (IEEE 802.15.1), before communication is performed between the computer system 60 and one of the transmitting devices 10, the transmitting device 10 must be bonded ("paired") with the computer system 60. To do this, a program is initiated, for example, displaying a user interface 100 (see FIG. 4) 200 and initializing 202 the Bluetooth transceiver 94 to receive the pairing protocol from the transmitting device 10. The user interface requests that the user press the switch button 14 on the transmitting device 10 which is to be paired. Next, the software waits 204 for the switch button 14 to be pressed, at which time a signal packet will be received wirelessly by the Bluetooth transceiver 94. In some embodiments, after a period of time passes without receiving the signal packet, the software times out (not shown for clarity reasons).

Figure 13:
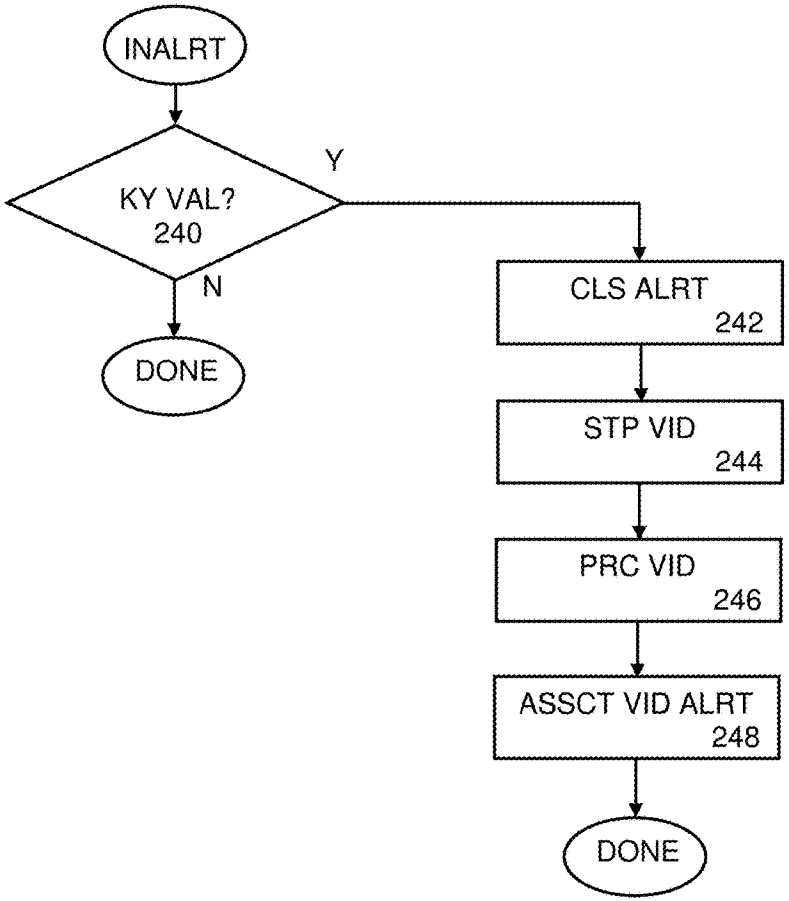
FIG. 13 illustrates a third software flow of the alert system.

Once it is detected 204 that a signal packet has been received from the transmitting device 10 (e.g., the switch button 14 was depressed), the key that is part of the signal packet is saved 206, for example in the alert data storage 62 (see FIG. 13). Note, in some embodiments in which there are multiple computer systems 60, the key is replicated across each computer system 60 so that each computer system 60 will recognize the transmitting device 10. Thereafter, each time the switch button 14 on the transmitting device 10 is pressed, the shared key is cryptographically used to make sure the transmitting device 10 is an already paired device.

To inform the user that the transmitting device 10 successfully paired with the computer system(s) 60, a second user interface 110 (as in FIG. 5) is displayed indicating success.

Figure 12:
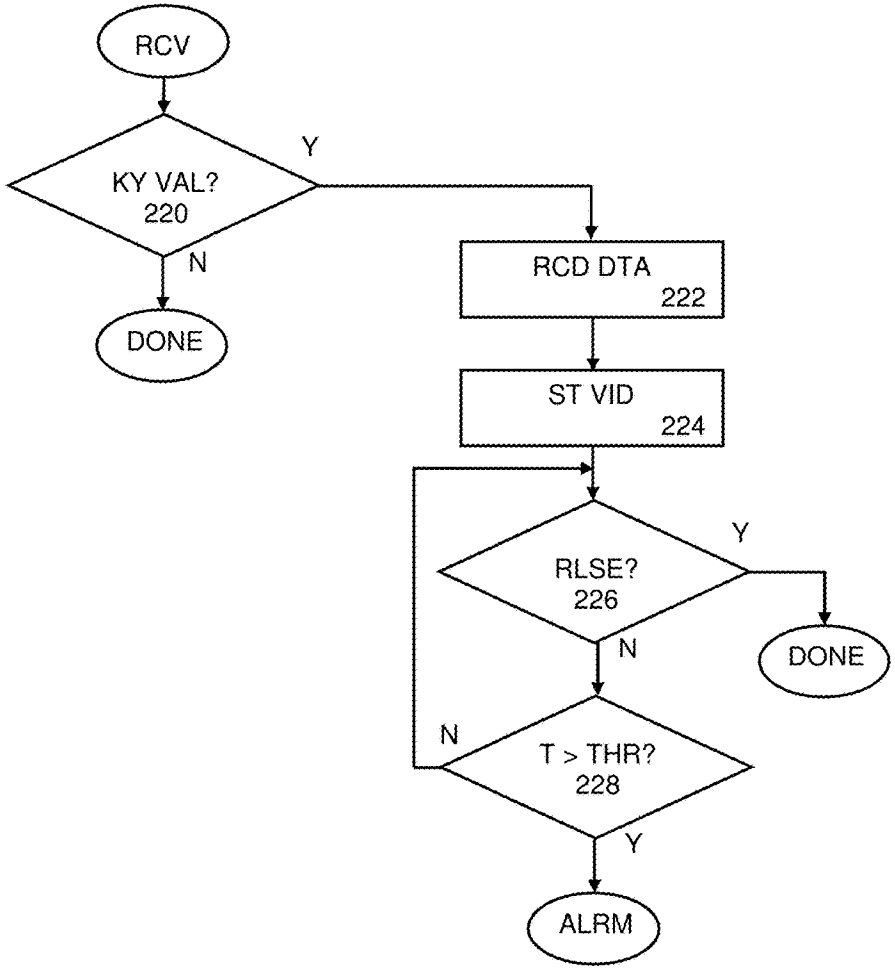
FIG. 12 illustrates a second software flow of the alert system.

Referring to FIG. 12, a second software flow of the alert system is shown. When a signal packet is received, the key value is checked to make sure the emitting transmitting device 10 is authorized, e.g., the transmitting device 10 was previously paired (see FIG. 11) and the key value is known. Note that there are many ways to accomplish and remember paired devices, all of which are included here within. If the key value does not match 220 any stored key values, it is assumed that the signal packet is from a foreign device (e.g., a cellular phone that is not registered/paired), and ignored.

If the key value matches 220 any stored key values, then an alert is initiated and data related to the alert is recorded 222, for example, the name of the teaching personnel that initiated the alert, the location (e.g., room number), the date, the time, etc. If there is at least one video camera in that location, video capture is started 224. Next, a loop is started, checking to see if the switch button 14 has been released 226, each pass through the loop. Note that, as long as the switch button 14 is held, sequential signal packets are transmitted by the transmitting device 10. One way to tell if the switch button 14 has been released is by timing between receipt of signal packets and, if no signal packet from the transmitting device 10 has been received for a period of time, declaring that the switch button 14 has been released. Once it has been determined that the switch button 14 of the transmitting device 10 has been released, the alert reception ends.

If, during the loop 226/228, a timer threshold is exceeded (e.g., the switch button was held for longer than a number of seconds, for example, three seconds), an alarm is initiated (e.g., law enforcement called, audible/visual alarm initiated, etc.).

Referring to FIG. 13, a third software flow of the alert system is shown. In this, a teaching personnel has previously initiated an alert by pressing the switch button 14 on their transmitter device 10 as described in FIG. 12. In FIG. 13, after the incident has been addressed by the teaching personnel, the switch button 14 on their transmitter device 10 is pressed, emitting another signal packet to close the alert. Again, the key value is verified 240 to make sure that the signal packet is from a registered transmitter device 10. If the key value is not recognized, the signal packet is ignored 240. If the key value is recognized, the key value and/or other information from the signal packet is used to match up with an active alert in order to close that active alert 242 and stopping capture of video 244. The video is processed 246, for example, compressing the video into MPEG-4 format, as known in the industry. The resulting video is stored 248 in the alert data 62 and associated with the alert that was closed.

Note that when an alarm is initiated (e.g. by holding the switch button 14 of a transmitter device 10 for a number of seconds), the process of FIG. 13 is not used to retire the alarm as it is assumed there is likely a violent act occurring and the transmitter device 10 is possible compromised by the perpetrator of the violent act.

Figure 14:
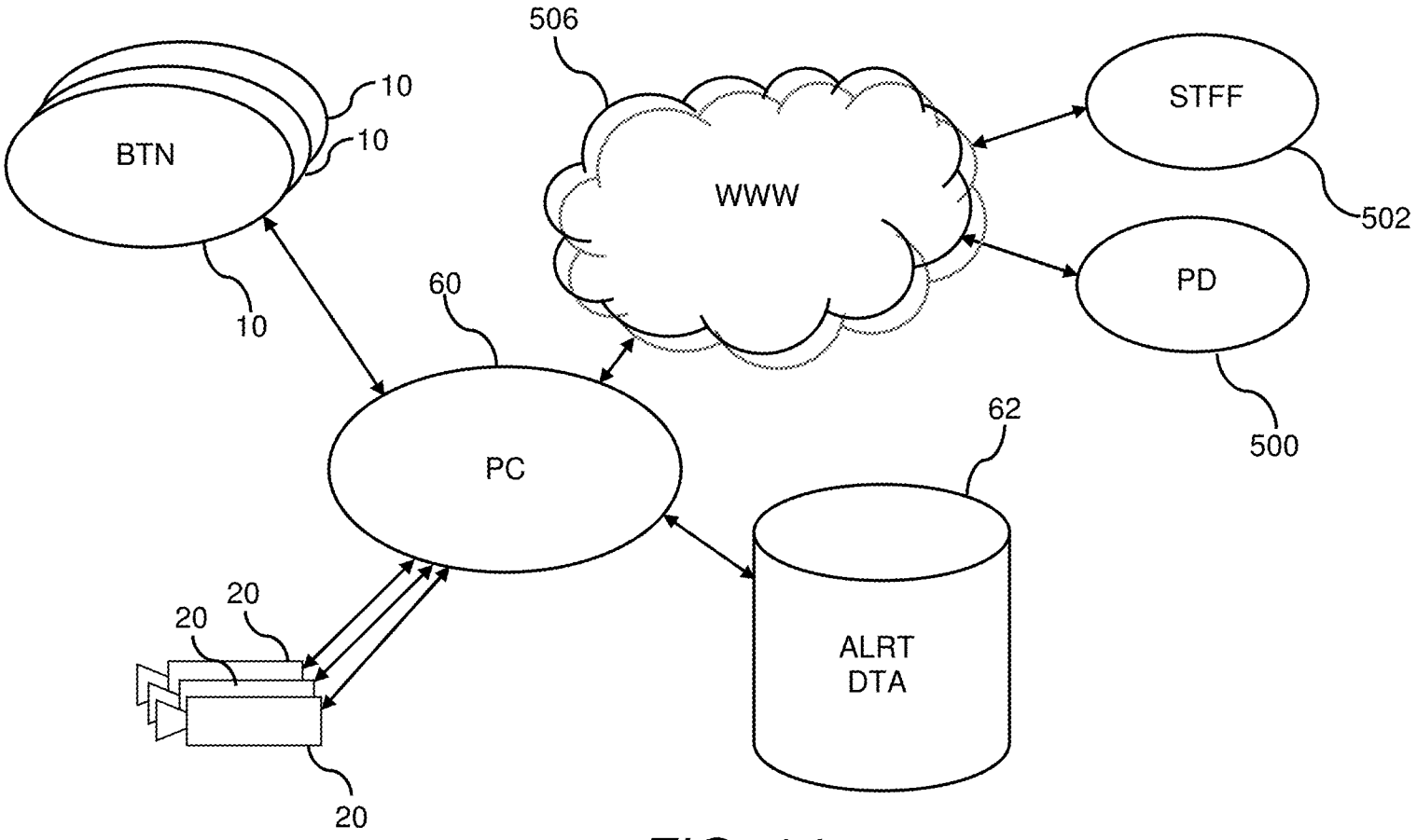
FIG. 14 illustrates an interaction diagram of the alert system.

Referring to FIG. 14, an interaction diagram of the alert system is shown. One or more transmitter devices 10 are carried/worn by teaching personnel. The transmitter devices 10 are paired with one or more computer systems 60 such that, each time a button switch 14 on any of the transmitter devices 10 is operated, a signal is wirelessly sent to the computer system(s) 60. As discussed with FIG. 12, video is received by the computer system(s) 60 from one of more video cameras 20 (and possibly audio capture as well), either through wired or wireless interfaces. The video is stored and/or compressed then stored in the alert data storage 62 for viewing, for example, after the alert subsides to understand what happened, provide evidence, determine if feedback or training is needed, etc. As discussed with FIG. 12, if the training personnel holds the switch button 14 on their transmitter device 10 for an extended period of time (e.g., three seconds), an alarm is initiated. When an alarm is initiated, video is captured as with an alert, but other steps are taken such as notifying law enforcement by, for example, sending a transaction to a law enforcement server 500 through a wide-area network 506 (e.g., the Internet), sending a text message or email to a certain administrative staff member's phone 502 (e.g., to the principal), etc.

Note that having one or more video cameras 20 in a class room are also useful for evaluation of teaching personnel. In this, video is captured during a specific classroom session, possibly unbeknown to the teaching personnel. In this way, evaluations are possible without the teaching personnel behaving differently than normal, either behaving better because they know they are being evaluated, or being nervous, etc. Note that some teacher unions do not allow random monitoring of classes for various legal reasons and, hence, in such situations, the video cameras 20 are only active when there is an alert or an alarm in progress.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. An alert system comprising:

a computer system;

a plurality of wireless transceivers interfaced to the computer system, each of the wireless transceivers located associated with a location of a facility;

a plurality of transmitting devices wirelessly connected to the computer system such that operation of a momentary-contact switch of any one of the transmitting devices transmits a wireless signal, each of the transmitting devices are wearable as a bracelet, as a necklace, as a brooch, or as a fob carried in a pocket;

at least one video camera operatively coupled to the computer system and mounted to the facility; and software running on the computer system, the software monitoring the plurality of wireless transceivers waiting for reception of the wireless signal from any of the wireless transceivers, the software initiating capture of video from at least one of the at least one video camera responsive to the software detecting receipt of the signal from one of the transmitting devices by one of the wireless transceivers;

whereas operating of the momentary-contact switch for a first length of time signals recording of video from the at least one video camera and operating of the momentary-contact switch for a second length of time that is greater than the first length of time signals an alarm.

2. The alert system of claim 1, wherein the software, responsive to detecting a second of the wireless signals from the any one of the transmitting devices stops capture of the video from the at least one of the at least one video camera and the software processes and stores the video in storage of the computer system.

3. The alert system of claim 1, wherein the software signals an alarm responsive to detecting operating of the momentary-contact switch for a second length of time by a continuous reception of the wireless signal for the second length of time.

4. The alert system of claim 3, wherein the alarm includes sending a notification to a law enforcement agency.

5. The alert system of claim 3, wherein the alarm includes making a phone call from the server to a law enforcement emergency number and after a connection is made, playing of a prerecorded message over the connection.

6. The alert system of claim 3, wherein the alarm includes making a phone call from the server to a law enforcement emergency number and after a connection is made, converting a text message into voice and emitting the voice over the connection.

7. The alert system of claim 3, wherein the alarm includes sending a notification to an administrative staff.

8. The alert system of claim 1, whereas the software determines a location of the transmitting device by determining which of the wireless transceivers received the wireless signal.

9. An alert system comprising:

a computer system having a wireless receiver;

a transmitting device having a momentary-contact switch for controlling when the transmitting device emits a wireless signal, transmitting device is wearable as a bracelet, as a necklace, as a brooch, or as a fob carried in a pocket;

at least one video camera operatively coupled to the computer system; and software running on the computer system, the software initiating capture of video from at least one of the at least one video camera responsive to the software detecting receipt of the wireless signal from the transmitting device;

whereas operating of the momentary-contact switch for a first length of time signals recording of video from the at least one video camera and operating of the momentary-contact switch for a second length of time that is greater than the first length of time signals an alarm.

10. The alert system of claim 9, wherein the software, responsive to detecting a second of the wireless signal from the transmitting device, stops capture of the video from the at least one of the at least one video camera and the software processes and stores the video in storage of the computer system.

11. The alert system of claim 9, wherein the software signals an alarm responsive to detecting the wireless signal for a period of time that is greater than the second length of time.

12. The alert system of claim 11, wherein the alarm includes sending a notification to a law enforcement agency.

13. The alert system of claim 10, wherein the alarm includes making a phone call from the server to a law enforcement emergency number and after a connection is made, playing of a prerecorded message over the connection.

14. The alert system of claim 10, wherein the alarm includes making a phone call from the server to a law enforcement emergency number and after a connection is made, converting a text message into voice and emitting the voice over the connection.

15. The alert system of claim 10, wherein the alarm includes sending a notification to an administrative staff.

16. The alert system of claim 10, wherein the alarm includes initiating an audio and/or visual building alarm.

* * * * *